US007998341B2

(12) United States Patent
Báez et al.

(10) Patent No.: US 7,998,341 B2
(45) Date of Patent: Aug. 16, 2011

(54) PROCESS FOR TREATING HYDROCARBON FEEDS WITH ELECTROLYTIC HYDROGEN

(75) Inventors: Victor Báez, San Antonio de los Altos (VE); Luis Felipe D'Elia, San Antonio de los Altos (VE); Gaudy Rodriguez, San Antonio de los Altos (VE)

(73) Assignee: Intevep, S.A., Caracas (VE)

( * ) Notice: Subject to any disclaimer, the term of this patent is extended or adjusted under 35 U.S.C. 154(b) by 661 days.

(21) Appl. No.: 12/142,139

(22) Filed: Jun. 19, 2008

(65) Prior Publication Data

US 2008/0251422 A1 Oct. 16, 2008

Related U.S. Application Data

(60) Continuation-in-part of application No. 11/650,083, filed on Jan. 4, 2007, now abandoned, which is a division of application No. 10/984,462, filed on Nov. 8, 2004, now Pat. No. 7,244,351.

(51) Int. Cl.
*C10G 45/06* (2006.01)

(52) U.S. Cl. ..... 208/251 H; 208/251 R; 208/254 H; 205/343; 205/345; 204/172; 429/408; 429/422; 429/425

(58) Field of Classification Search ..... 208/208 R, 208/251 R, 251 H, 254 H; 205/343, 345, 205/413, 462; 204/164, 168, 172; 429/408, 422, 425

See application file for complete search history.

(56) References Cited

U.S. PATENT DOCUMENTS

| | | | | |
|---|---|---|---|---|
| 5,981,097 | A * | 11/1999 | Rajendran | 429/494 |
| 6,132,590 | A * | 10/2000 | Moran et al. | 205/496 |
| 6,475,376 | B2 * | 11/2002 | Jossens et al. | 208/213 |
| 6,653,005 | B1 * | 11/2003 | Muradov | 429/410 |
| 7,001,504 | B2 * | 2/2006 | Schoonover | 208/236 |
| 7,025,875 | B2 * | 4/2006 | Grieve et al. | 208/208 R |

* cited by examiner

*Primary Examiner* — Robert J Hill, Jr.
*Assistant Examiner* — Brian McCaig
(74) *Attorney, Agent, or Firm* — Bachman & LaPointe, P.C.

(57) ABSTRACT

A process for treating hydrocarbon feeds includes the steps of providing a hydrocarbon feed containing sulfur and/or metalloporphyrins; providing a cell having two compartments and a membrane separating the compartments; flowing a hydrogen source through one compartment; flowing the hydrocarbon feed through the other compartment; applying a current across the hydrogen source compartment whereby hydrogen diffuses through the membrane from the hydrogen source to the hydrocarbon feed, whereby the hydrogen reacts with sulfur and/or metalloporphyrins to form $H_2S$ and convert such metalloporphyrins into dissolved metals and a free metal porphyrin, and produce a treated hydrocarbon.

18 Claims, 6 Drawing Sheets

PROCESS FOR TREATING HYDROCARBON FEEDS WITH ELECTROLYTIC HYDROGEN

CROSS-REFERENCE TO RELATED APPLICATIONS

This application is a continuation-in-part of U.S. patent application Ser. No. 11/650,083, filed Jan. 4, 2007, now abandoned, which is a divisional application of U.S. patent application Ser. No. 10/984,462, filed Nov. 8, 2004, now U.S. Pat. No. 7,244,351.

BACKGROUND OF THE INVENTION

The invention relates to treatment of hydrocarbon feeds, and more particularly to treatment of such feeds to convert metalloporphyrins.

Crude oil contains metal in amounts which can vary from a few parts per million to more than 1,000 ppm. Sodium, lithium, calcium, strontium, copper, silver, vanadium, manganese, tin, lead, cobalt, titanium, gold, chromium and nickel are some of the metals found in such oil. These metals are usually combined with naphthenic acid forming organometallic complexes such as metalloporphyrins. Among these metals, vanadium and nickel are most abundant. These metals restrict commercialization of the crude, and can cause problems in refining. For example, the metalloporphyrins tend to be retained in the residue during distillation and FCC processes. Further, these metals can dramatically affect performance of the catalyst for refining processes.

Various expensive approaches, such as hydrotreatment and gasification, have been attempted to remove such metals, without complete success.

Optimal operation of many hydrocarbon upgrading processes is strongly affected by metal presence. Any up-stream oil treatment process, upstream of an FCC unit, can provide a benefit through metal removal.

It is clear that the need remains for an economical and efficient process for removing metals, and especially metalloporphyrins, from hydrocarbon feeds.

It is therefore the primary object of the present invention to provide such process.

Other objects and advantages of the present invention will appear herein below.

SUMMARY OF THE INVENTION

In accordance with the present invention, the foregoing objects and advantages have been readily obtained.

According to the invention, a process is provided for removing sulfur and/or metalloporphyrins from hydrocarbon feeds, which process comprises the steps of providing a hydrocarbon feed containing sulfur and/or metalloporphyrins; providing a cell having two compartments and a membrane separating the compartments; flowing a hydrogen source through one compartment; flowing the hydrocarbon feed through the other compartment; applying a current across the hydrogen source compartment whereby hydrogen diffuses through the membrane from the hydrogen source to the hydrocarbon feed, whereby the hydrogen reacts with sulfur and/or metalloporphyrin compounds to form $H_2S$ and/or dissolved metals-porphyrin and provide a treated hydrocarbon.

The chemical composition and morphology of the membranes can affect the hydrogen permeation rate and, therefore, the reactivity. For example if the membrane is composed by other metals (gold or nickel instead of palladium), the atomic hydrogen reactivity and permeability of the membrane is strongly affected.

BRIEF DESCRIPTION OF THE DRAWINGS

A detailed description of preferred embodiments of the present invention follows, with reference to the attached drawings, wherein.

DETAILED DESCRIPTION

The invention relates to a hydrogenation process and, more particularly, to a process for generating electrolytic hydrogen in situ, for treatment of hydrocarbon feeds, especially liquid hydrocarbon feeds, and also especially any hydrocarbon feedstock.

A typical feed for treatment according to the invention is a Venezuelan crude oil, for example having characteristics as shown in Table 1 below:

TABLE 1

| Characteristics | |
|---|---|
| API Gravity | 16.8 |
| Asphaltenes % w/w | 9.8 |
| Sulfur % w/w | 4.25 |
| Nitrogen % w/w | 0.57 |
| Vanadium ppm | 703 |
| Nickel ppm | 64 |

Hydrocarbon feeds frequently contain potentially large amounts of metals. Although numerous metals are an issue, the two most problematic are vanadium and nickel. Further, these metals can frequently be in metalloporphyrin species. Such metalloporphyrins can be very difficult to remove from a feedstock, and it is desirable to convert such species to make removal more easily accomplished.

In accordance with the present invention, hydrogen is permeated across a membrane and exposed to a hydrocarbon feed containing metals and/or sulfur. The hydrogen, in atomic form, reacts with the sulfur to remove the sulfur from different cyclic and other types of compounds, and transforms the sulfur compounds into $H_2S$ which is more easily removed from the hydrocarbon. The hydrogen also reacts with the olefins and aromatics of the metalloporphyrins species to convert these species into other forms which are much more easily removed. Metalloporphyrins are mainly composed of metal, nitrogen, and olefinic and aromatic groups. In the presence of active hydrogen, the olefinic and aromatic groups are expected to hydrogenate, and the metal should dissolve in the liquid in reduced form.

According to the invention, an electrochemical cell is used to produce hydrogen, for example from water or any other suitable hydrogen source, and permeate the hydrogen across a membrane into contact with a hydrocarbon containing the sulfur hydrocarbon and/or metalloporphyrin compounds contained in crude oil.

Figure 1:
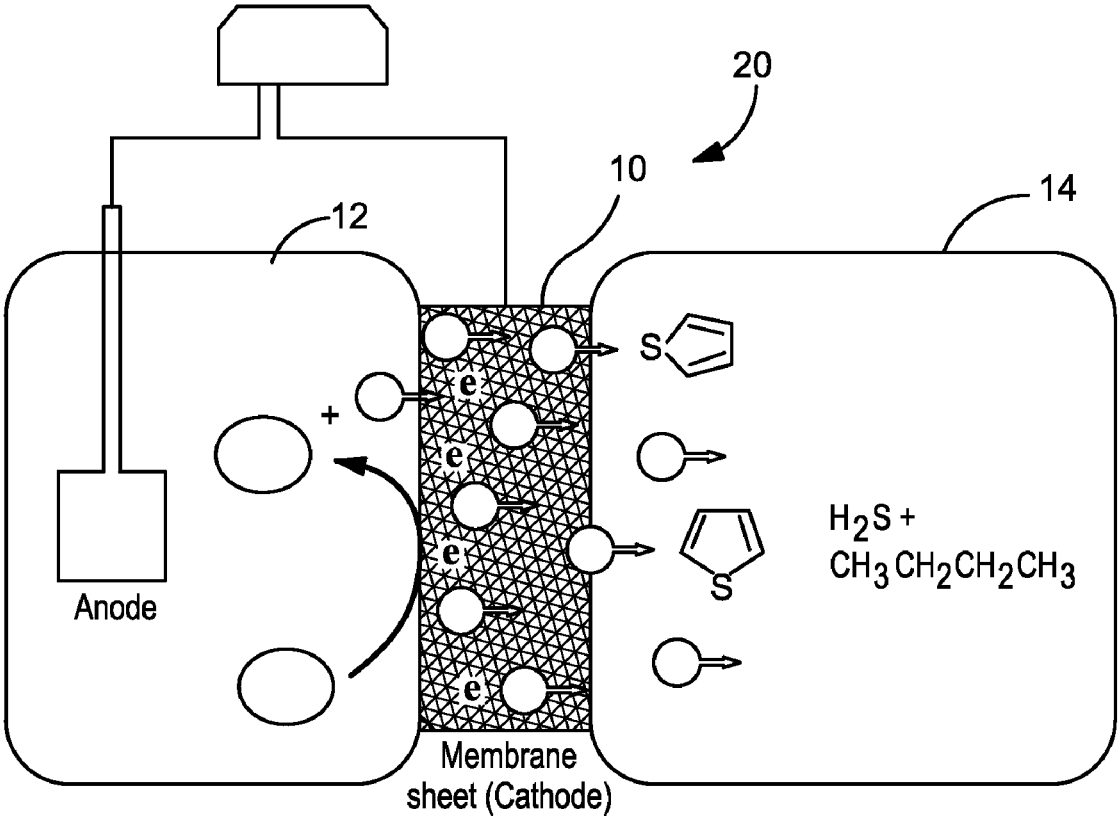
FIG. 1 schematically illustrates a system and process in accordance with the present invention.

FIG. 1 shows a process in accordance with the present invention wherein a membrane sheet 10 is positioned between two compartments or flow areas 12, 14, and wherein a hydrogen source material is passed through one flow area 12 while the hydrocarbon containing sulfur and/or metalloporphyrins is passed through the other flow area 14. Applying a current across the metallic sheet configures the first flow area 12 as anode and membrane sheet 10 as cathode. The applied current serves to separate off hydrogen in atomic form on the surface of membrane sheet 10, which then permeates through this membrane and into flow area 14. In this area, the extremely reactive hydrogen couples with sulfur-containing hydrocarbons to form $H_2S$ and produce a sulfur-free hydrocarbon and also hydrogenates the olefins and aromatics of the metalloporphyrins producing a metal-free base porphyrin. It is believed that the hydrogen may also serve to upgrade the quality of the feed, and this is a secondary beneficial effect of the process of the present invention. The hydrocarbon feed may include gasoline, diesel, jet fuel, heavy oil, distillates and other feeds.

In accordance with the present invention, the electrochemical cell 20, including membrane 10 and compartments 12, 14, is provided including a membrane which advantageously is electrically conductive and stable as cathode during electrolysis.

The membrane sheet can advantageously comprise at least one material selected from the group consisting of iron, iron alloys, nickel, gold, platinum, palladium, palladium alloys and mixtures thereof. These materials are found to be excellent for use in separating hydrogen from a hydrogen source and permeating the hydrogen through the membrane. It may also be advantageous to deposit a porous layer of metals on a membrane sheet such as palladium, gold, silver, nickel, copper, lead and other metallic elements belonging to the platinum group. The reason is that the porous layer may act as a catalytic layer for permeating atomic hydrogen. This deposition can be carried out by permeation of electrolytic hydrogen generated "in situ".

In further accordance with the invention, the anode or flow compartment 12 can advantageously comprise a material selected from the group consisting of platinum, nickel, iron, iron alloys, gold, palladium and mixtures thereof.

The membrane can advantageously have a thickness of between about 0.005 and about 2.5 mm.

Such a membrane is effective in the process of the present invention when a current is applied across the same at a current density of between about 1.6 and about 80 $mA/cm^2$.

In further accordance with the invention, a solution is advantageously provided at the hydrogen source side of the membrane. This solution can be alkaline solution, acid solution or just water, and can also advantageously be provided as an electrolyte solution, most preferably as sodium hydroxide, potassium hydroxide, calcium hydroxide and the like. This solution can advantageously be provided in a concentration of between about 0.001 M and 10 M.

Electrolytic cells such as that described in accordance with the process of the present invention are well known in hydrogen generating arts, and further details as to specific operating structures and parameters would be known to a person of ordinary skill in the art.

Figure 2A:
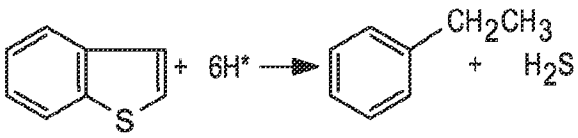
FIGS. 2*a* and 2*b* further illustrate a reaction in accordance with the process of the present invention.

In further accordance with the specific process of the present invention, one particularly difficult sulfur-containing compound which is commonly present in hydrocarbon feeds is thiophene. A thiophene type molecule and a desulfurization step is shown in FIG. 2*a*. The molecule contains sulfur in a location where it is difficult to remove. It has been found in accordance with the present invention, however, that these thiophene compounds, when exposed to atomic hydrogen, are converted so as to remove the sulfur from the compound and form $H_2S$, and a substantially sulfur free hydrocarbon. This is advantageous since the $H_2S$ is now in an easily removed form, and the remaining hydrocarbon does not contain the removed sulfur.

Figure 2B:
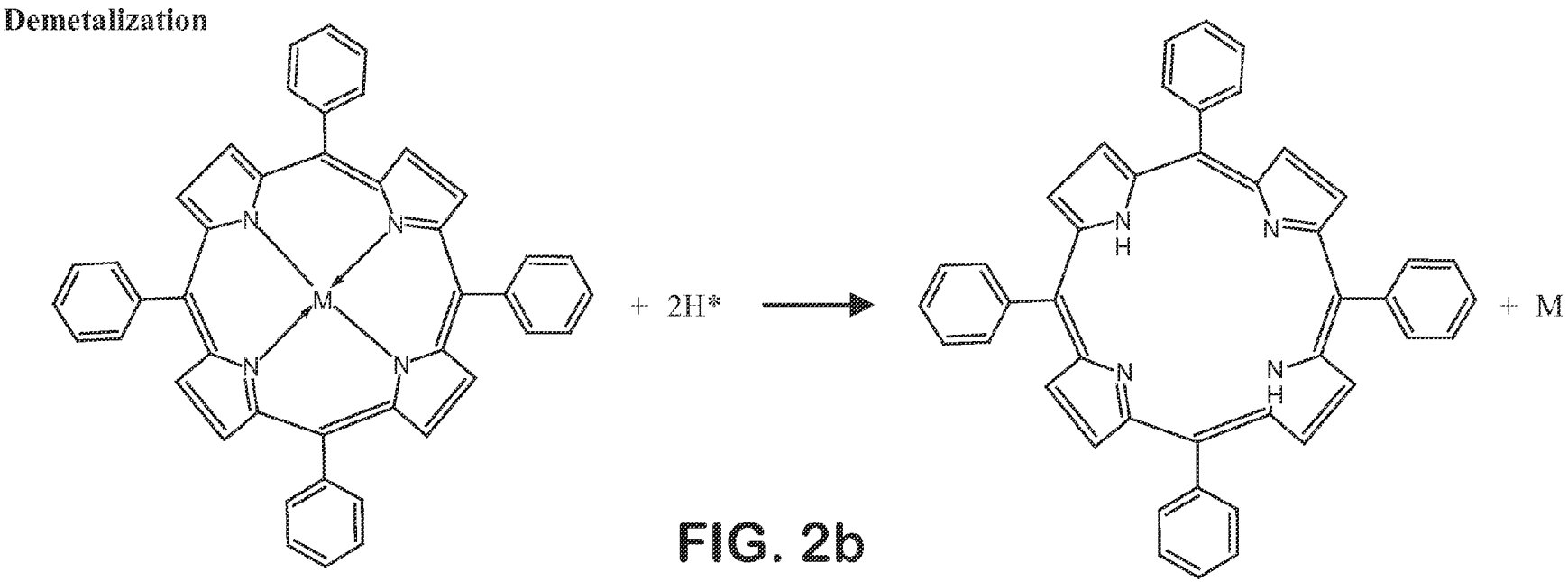

FIG. 2*b* shows a demetalization reaction with similar results to facilitate metal removal.

In further accordance with the present invention, the process can be carried out at a temperature of between about 25° C. and about 300° C. These temperatures are advantageously substantially lower than conventional hydro-desulphurization processes.

In accordance with the invention, atomic hydrogen permeating through the membrane can react with sulfur organic and/or metalloporphyrin compounds either at the surface of membrane 10, upon contacting the hydrocarbon, or in the interface between the solution and membrane sheet.

It may be desirable in accordance with the process of the present invention to circulate the hydrocarbon feed within the second flow area or compartment 14, so as to increase the contact efficiency between the sulfur organic and/or metalloporphyrin compounds and the membrane sheet through which hydrogen permeates.

The reaction can be carried out at flow rates through the chambers or the compartments of the cell which are sufficient to allow sulfur organic and/or metalloporphyrin compounds to be removed to a desired level.

In accordance with the present invention, the process provided advantageously allows for deep desulfurization and/or removal of metalloporphyrins from hydrocarbon feedstocks with or without a minimal yield loss, and further provides for removal of sulfur and/or metalloporphyrins at low severity temperatures and pressures. This is particularly desirable as the quality of the hydrocarbon itself is thereby maintained and potentially, improved. In addition, there is no evidence of loss of activity of the membrane sheet during the reaction, and further the process does not have a hydrogen efficiency decay as is experienced with conventional hydrodesulfurization methods. This is due to the fact that hydrogen is continuously supplied electrolytically and, therefore, the sulfur and/or metalloporphyrin removal process is continuously conducted. Furthermore, the rate of sulfur and/or metalloporphyrin compound removal or conversion can be controlled by regulating the current density.

The following examples demonstrate the process in accordance with the present invention.

EXAMPLE 1

This example was carried out using an extract of Venezuelan crude oil having an API gravity of 17. See Table 1 above. The crude was extracted using liquid-liquid extraction with acetonitrile. A demetalization reaction was performed using a palladinized palladium sheet (palladium black) prepared following known procedures. Operating conditions for the demetallization, or porphyrin conversion reaction, were as follows: Electrolyte medium: NaOH 0.1M, current density: −31 $mA/cm^2$, cathode: palladium black, cathode thickness: 0.125 mm, anode: platinum mesh, reaction temperature: 20° C., feedstock: 100 ml of dichloromethane + extract of Venezuelan crude oil having an API gravity of 17, electrolysis time: 24 hours.

Figure 3:
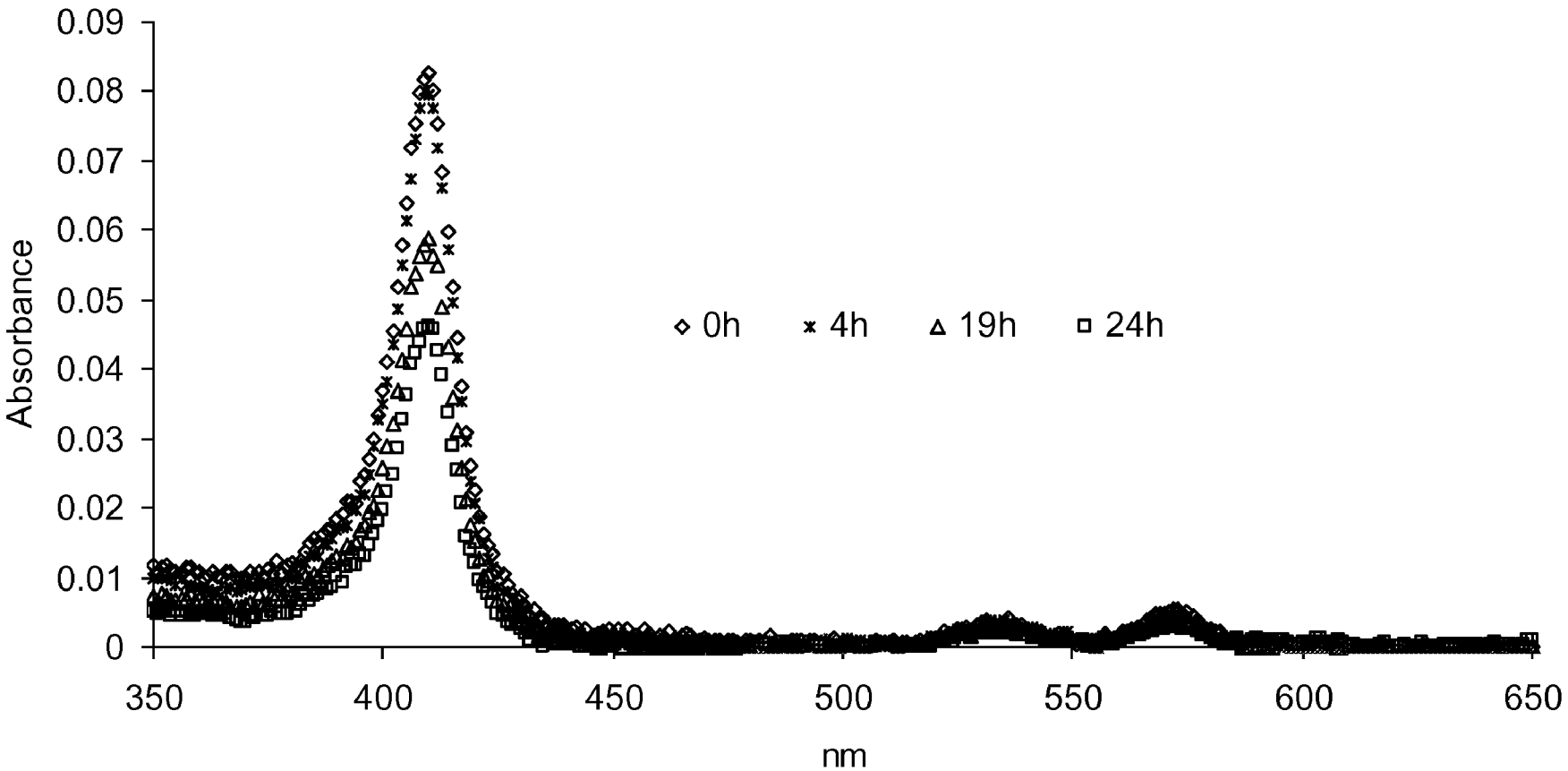
FIG. 3 is a UV-Visible spectra of a Venezuelan crude oil extract at different reaction times.

UV-visible spectra were obtained of the feedstock at 0, 4, 19 and 24 hours, and these spectra are shown in FIG. 3. The porphyrin absorption band clearly diminishes over the time of the reaction, indicating that porphyrin conversion is taking place. The conversion rate is estimated at 44% for the 24 hours period. Further, this conversion is obtained at non-severe conditions.

EXAMPLE 2

This example was conducted using a commercialized porphyrin 5, 10, 15, 20 tetraphenyl 21H, 23H porphine oxides vanadyl (IV) (151 ppm) as a model molecule. The palladinized palladium sheet used in this example was the same as was used in Example 1. Operating conditions for the demetallization, or vanadium porphyrin conversion reaction, were as follows: Electrolyte medium: NaOH 0.1M, current density: −31 mA/cm$^2$, cathode: palladium black, cathode thickness: 0.125 mm, anode: platinum mesh, reaction temperature: 20° C., feedstock: 100 ml of dichloromethane with 151 ppm vanadium porphyrin, electrolysis time: 24 hours.

Figure 4:
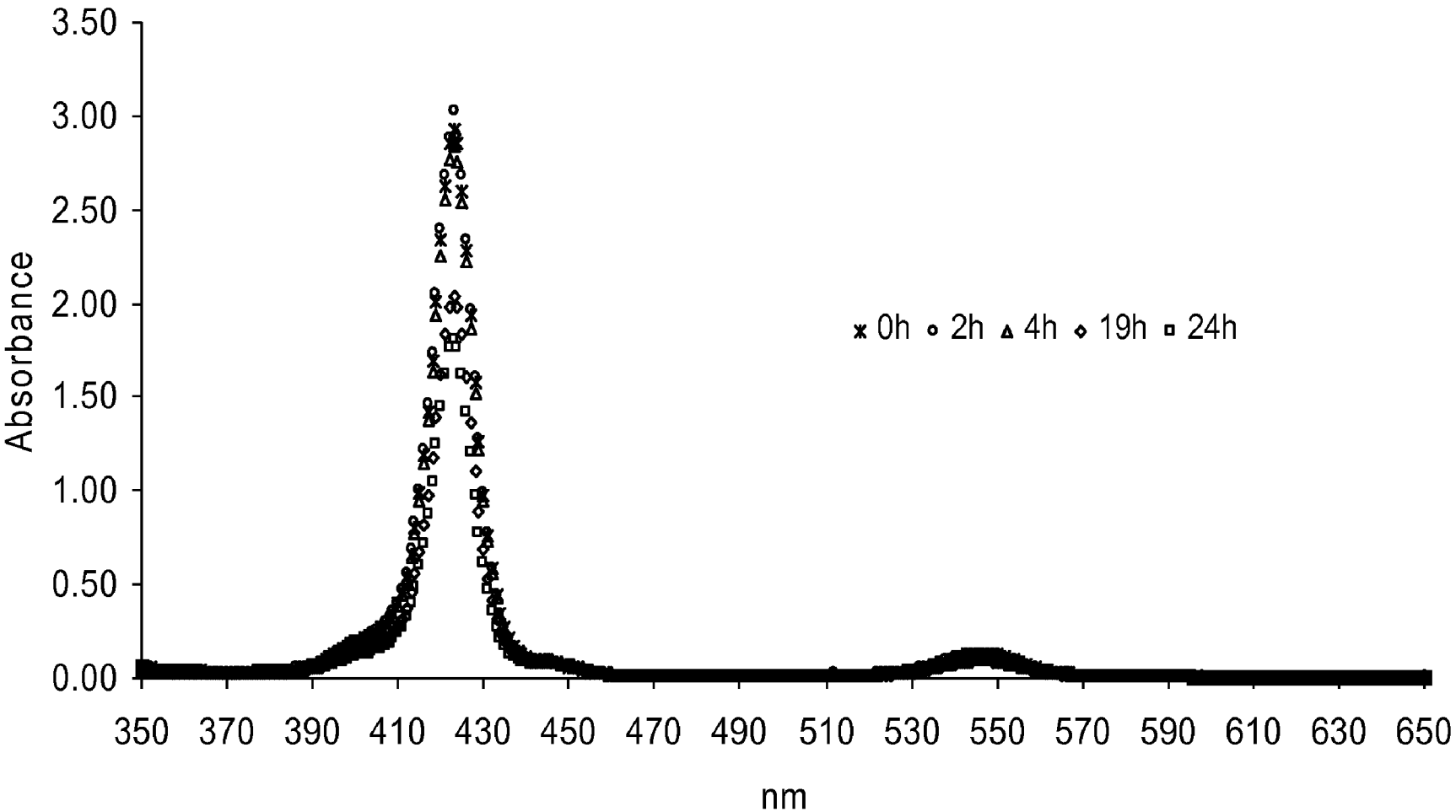
FIG. 4 is a UV-Visible spectra of vanadyl porphyrin at different reaction times.

UV-visible spectra were again obtained, and are shown in FIG. 4. The UV-Visible spectra clearly show that the porphyrin absorption band diminishes as the reaction time proceeds. Porphyrin conversion for this reaction is estimated at 38% over the 24 hour period. This demonstrates that the process of the present invention is effective at large and small amounts of metalloporphyrins in the feedstock. This indicates that the process can be coupled to conventional refining processes in order to avoid all the various problems related to metal content in the oil fractions.

EXAMPLE 3

This example was conducted using porphyrin 5, 10, 15, 20 tetraphenyl 21H, 23H porphine oxides vanadyl (IV) (4 ppm). The palladinized palladium sheet used in this example was the same as used in Example 1. The operating conditions for the demetalization or vanadium porphyrin conversion reaction were as follows: Electrolyte medium: NaOH 0.1M, current density: −31 mA/cm$^2$, cathode: palladium black, cathode thickness: 0.125 mm, anode: platinum mesh, reaction temperature: 20° C., feedstock: 100 ml of dichloromethane with 4 ppm vanadium porphyrin, electrolysis time: 24 hours.

Figure 5A:
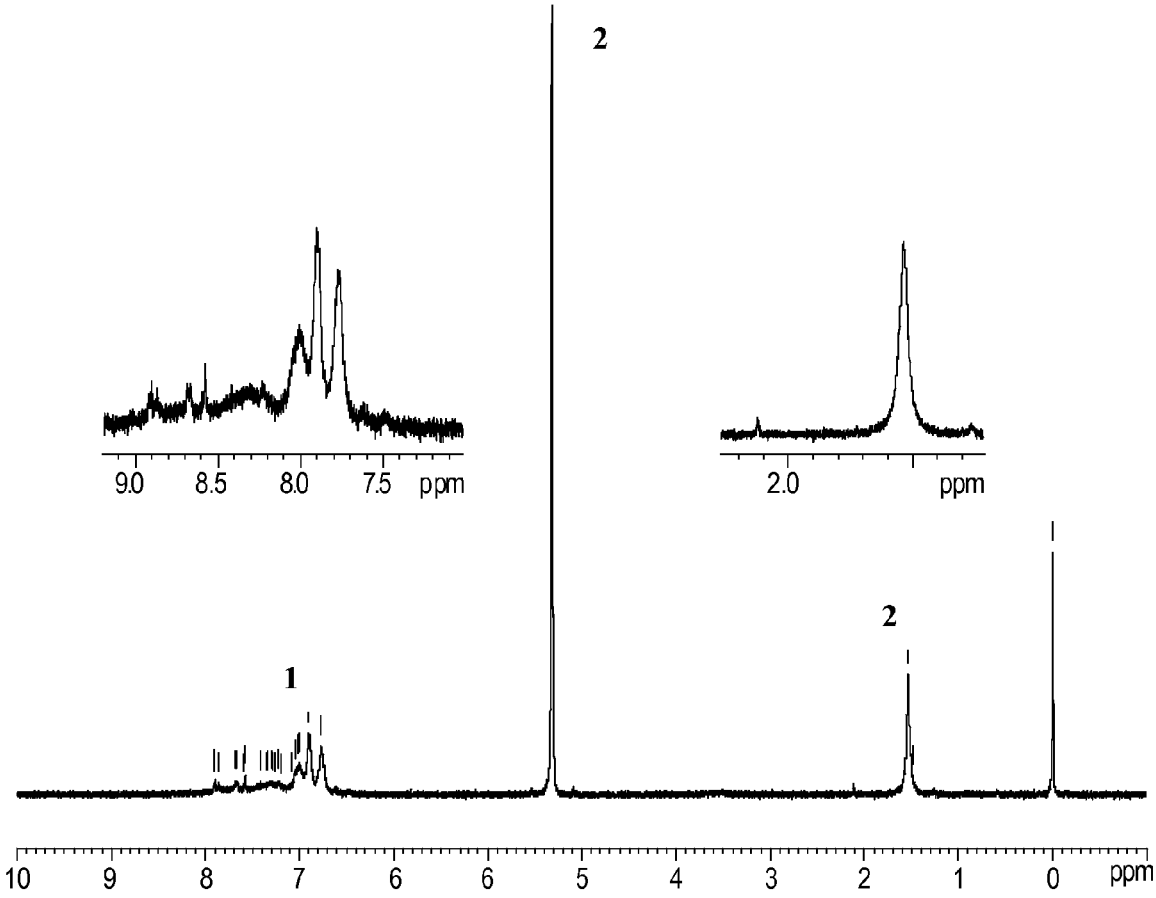
FIGS. 5*a* and 5*b* are $RMN^1H$ spectra of the reaction mixture at different reaction times (0 h and 24 h).
Figure 5B:
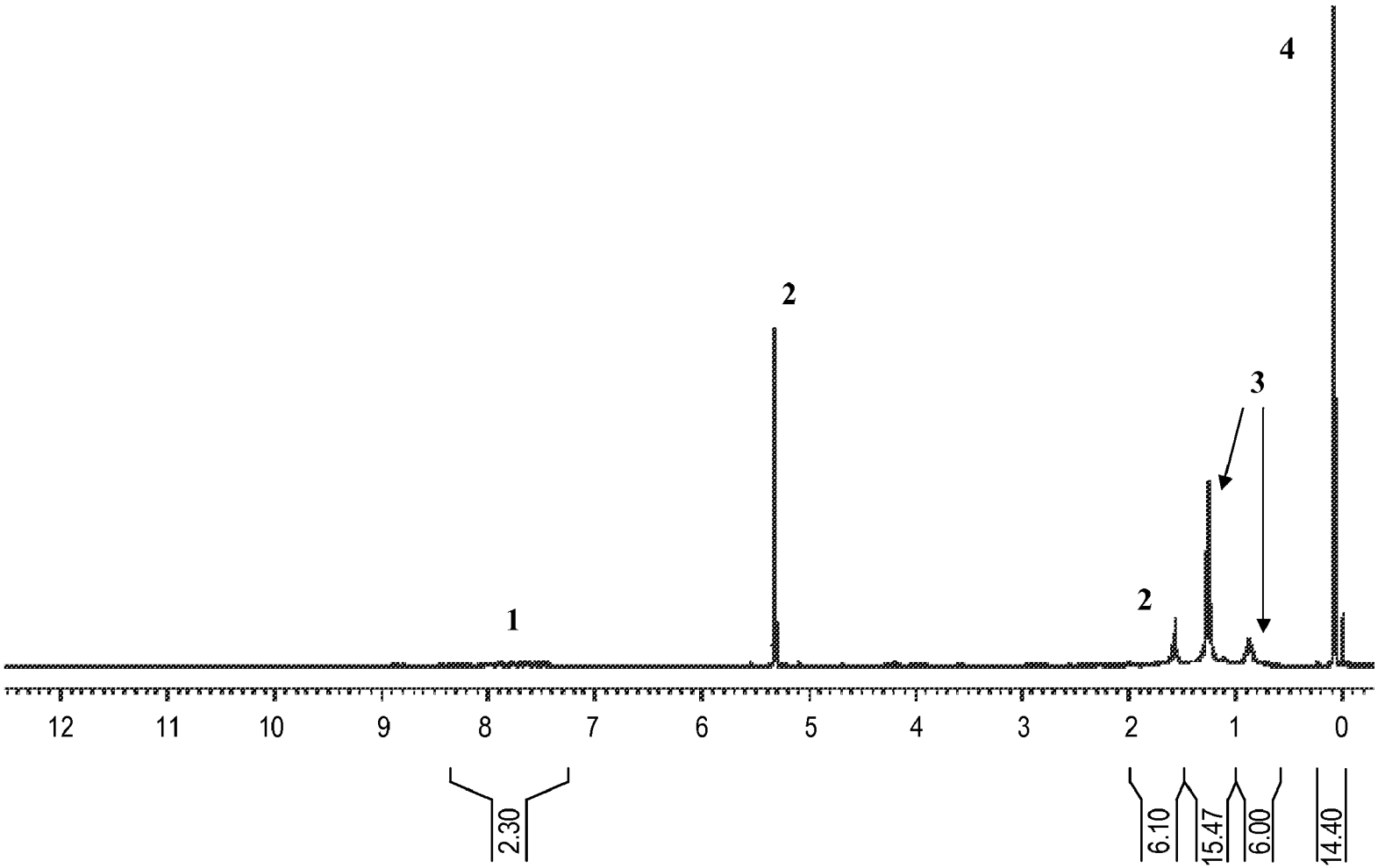

FIG. 5 shows the porphyrin RMN$^1$H spectra of the mixture at two different reaction times. Observations included the finding of pyrrolic and aromatic protons between 7 and 9 ppm, a decrease in peak intensity (due to transformation of the pyrrolic and aromatic rings) as the reaction progresses, and the presence of a signal assigned to primary amine protons between 0.8 and 1.26 ppm. This reinforces the fact that pyrrolic rings are transformed. Further, at 0.11 ppm there is a signal related to aliphatic protons ($C_{sp}^3$), see Table 2.

TABLE 2

| RMN$^1$H spectra assignment | |
|---|---|
| Signals | Possible Allocations |
| 1 | 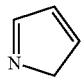 and 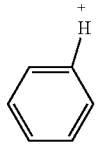 |
| 2 | —$CH_2Cl_2$ |

TABLE 2-continued

| RMN$^1$H spectra assignment | |
|---|---|
| Signals | Possible Allocations |
| 3 | —$NH_2$ |
| 4 | —$CH_2$ |

Finally, signals between 5.3 and 1.5 ppm are produced by the solvent (deuterade dichloromethane).

The RMN$^1$H spectra clearly indicate that porphyrins are transformed. This suggests that the porphyrins react with the active hydrogen and generate saturated species such as hydrogenated pyrrolic and non aromatic compounds. This hydrogenation process leads to demetallization according to the invention, and thus hydrogen permeation can be considered as a route for porphyrin metal removal from oil fractions.

In accordance with the present invention, it should be readily appreciated that a process has been provided for utilizing electrolysis to generate hydrogen "in situ" for removal of sulfur and/or metalloporphyrins from hydrocarbon feed stocks. The resulting hydrocarbon product has a reduced content of sulfur and/or metalloporphyrins in this form, and can further have upgraded components or quality as well. The process is carried out at significantly lower temperatures and pressures than conventional hydro desulfurization and/or demetallization processes and can be utilized to remove sulfur and/or metals with an excellent efficiency.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for treating hydrocarbon feeds, comprising the steps of:

providing a hydrocarbon feed containing metalloporphyrins;

providing a cell having two compartments and a membrane separating the compartments;

flowing a hydrogen source through one compartment;

flowing the hydrocarbon feed through the other compartment; and applying a current across the hydrogen source compartment whereby hydrogen is generated on a surface of the membrane and diffuses through the membrane from the hydrogen source to the hydrocarbon feed, whereby the hydrogen reacts with metalloporphyrins to convert the metalloporphyrins and provide a treated hydrocarbon.

2. The process of claim 1, wherein converting the metalloporphyrins produces metals, and further comprising removing the metals.

3. The process of claim 1, wherein the metalloporphyrins are selected from the group consisting of vanadium porphyrin, nickel porphyrin, mixtures thereof.

4. The process of claim 1, wherein the hydrocarbon feed comprises an FCC feedstock.

5. The process of claim 1, wherein the hydrocarbon feed also contains sulfur in different types of compounds, and wherein the hydrogen reacts with these different types of compounds to form $H_2S$ and desulfurized compounds.

6. The process of claim 1, wherein the process is carried out at a temperature of between about 25° C. and about 300° C.

7. The process of claim 1, wherein the membrane is electrically conductive and stable as a cathode during electrolysis so as to provide one of the electrodes.

8. The process of claim 7, wherein the membrane comprises at least one material selected from the group consisting of iron, iron alloys, nickel, gold, platinum, palladium, palladium alloys, and mixtures thereof.

9. The process of claim 8, wherein deposition of metals on surfaces of the membrane provides an upgrade in at least one of atomic hydrogen permeation and atomic hydrogen reactivity against the hydrocarbon feed.

10. The process of claim 8, wherein the anode comprises a material selected from the group consisting of platinum, nickel, iron, iron alloys, gold, palladium and mixtures thereof.

11. The process of claim 1, wherein the membrane has a thickness of between about 0.005 and about 2.5 mm.

12. The process of claim 1, wherein the hydrogen which diffuses across the membrane is atomic hydrogen.

13. The process of claim 1, wherein the hydrocarbon feed comprises sulfur, and wherein the treated hydrocarbon has a reduced amount of sulfur as compared to the feed.

14. The process of claim 1, wherein the applying step comprises applying current at a current density of between about 1.6 and about 80 $mA/cm^2$.

15. The process of claim 1, further comprising the step of providing a solution for generating atomic hydrogen at the hydrogen source side of the membrane.

16. The process of claim 15, wherein the solution is selected from the group consisting of alkaline solutions, acid solutions water and combinations thereof.

17. The process of claim 15, wherein the solution is an electrolyte solution.

18. The process of claim 15, wherein the solution comprises sodium hydroxide solution at a concentration of between about 0.001 M and about 10 M.

* * * * *